US006601244B1

(12) United States Patent
Goettl

(10) Patent No.: US 6,601,244 B1
(45) Date of Patent: Aug. 5, 2003

(54) APPARATUS FOR CLEANING SWIMMING POOLS

(75) Inventor: John M. Goettl, Phoenix, AZ (US)

(73) Assignee: Paramount Leisure Industries, Inc., Tempe, AZ (US)

( * ) Notice: Subject to any disclaimer, the term of this patent is extended or adjusted under 35 U.S.C. 154(b) by 95 days.

(21) Appl. No.: 09/714,491

(22) Filed: Nov. 17, 2000

(51) Int. Cl.[7] ..... E04H 4/16
(52) U.S. Cl. ..... 4/490; 239/204
(58) Field of Search ..... 4/490; 239/201, 239/203, 204, 206

(56) References Cited

U.S. PATENT DOCUMENTS 5,251,343 A * 10/1993 Goettl ..... 4/490

* cited by examiner

*Primary Examiner*—Charles E. Phillips
(74) *Attorney, Agent, or Firm*—Cahill, Sutton & Thomas P.L.C.

(57) ABSTRACT

A removable retainer for holding a nozzle stem in a body has opposed indentations for receiving the tines of a forded tool. The periphery of the retainer and the inner edge of the body are relieved to receive and guide the tool tines to the indentations.

4 Claims, 3 Drawing Sheets

APPARATUS FOR CLEANING SWIMMING POOLS

TECHNICAL FIELD

This invention is concerned with improving the performance and reliability of pop-up water delivery nozzles employed in swimming pool cleaning systems.

BACKGROUND ART

A number of pool cleaning systems have been devised utilizing strategically placed pop-up nozzles which are intermittently supplied with pressurized water. In repose, or inactive, each nozzle is retracted into a body so that its top surface is flush with the pool surface. When activated with pressurized water the nozzle rises above the pool surface and directs a stream of water across the surface to dislodge deleterious material from the surface and place it in suspension so it can be removed by the pool filter. Typically, such nozzles are caused to rotate a small amount about their axes with each activation so that a different area of pool surface is swept with each activation.

U.S. Pat. No. 4,322,860, granted Apr. 6, 1982 to Henry D. Gould for "Pool Cleaning Head with Rotary Pop-Up Jet Producing Elements" discloses such a pop-up nozzle. The mechanism for retracting and rotating the Gould nozzle employs a spring and cams and cam followers which are susceptible to breakage in use.

The same lack of reliability can be attributed to the nozzles disclosed in U.S. Pat. No. 4,371,994 granted Feb. 8, 1983 to Lester R. Mathews for "Rotational Indexing Nozzle Arrangement", and U.S. Pat. No. 5,251,343, granted Oct. 12, 1993 to John M. Goettl for "Swimming Pool Pop-Up Fitting".

Somewhat simpler nozzles are disclosed in U.S. Pat. No. 4,391,005 granted Jul., 5, 1983 to John M. Goettl for "Apparatus for Cleaning Swimming Pools", U.S. Pat. No. 4,792,095 granted Dec. 20, 1988 to Paul J. Pristo et al. for "Buffered, Fluid Dispensing Nozzle Unit", and U.S. Pat. No. 4,939,797granted Jul. 10, 1990 to John M. Goettl for "Water Delivery Assembly for Cleaning Swimming Pools". All of the nozzles disclosed in these patents rely on metal weights to retract the nozzle. However, these nozzles are susceptible to jamming from debris and also there is the possibility of fatigue of plastic components.

There continues to be a need for a more reliable delivery system.

SUMMARY OF THE INVENTION

Although the water delivery system of this invention has many features which contribute to its performance reliability, the feature stressed in this application is directed to facilitating removal of a defective or malfunctioning nozzle.

As with some prior nozzles, such as that disclosed in the Goettl '005 patent mentioned above, the retractable nozzle stem of this invention is held in place within a stationary body, or housing, by a retainer detachably connected to the body. Similarly, the retainer has opposed notches to receive a pronged tool for turning the retainer for installation and removal.

In accordance with this invention the retainer has these opposed notches, or indentations, in the peripheral region of the upper surface of the retainer and the remaining periphery of the retainer is relieved to provide a groove for retaining the tines of the tool and for guiding them into the indentations.

Preferably, the inner edge of the uppermost portion of the body is likewise relieved to accommodate the tool tines.

This arrangement steadies the tool as it is placed on the nozzle and aids in connecting the tool to the retainer.

The notched portion of the retainer is housed in a portion of the body lying entirely within the plaster portion of the pool wall. In other words, this notched portion of the retainer does not extend into the cement portion of the pool wall which allows the pipe supplying water to the system to surround and reinforce the body to the surface of the cement. This simplifies installation of the system inasmuch as the supply pipe is cut off flush with the surface of the cement rather than beneath that surface as has been required for some prior installations.

BRIEF DESCRIPTION OF THE DRAWINGS

The invention is described in greater detail hereinafter by reference to the accompanying drawings wherein.

BEST MODE FOR CARRY OUT THE INVENTION

Figure 1:
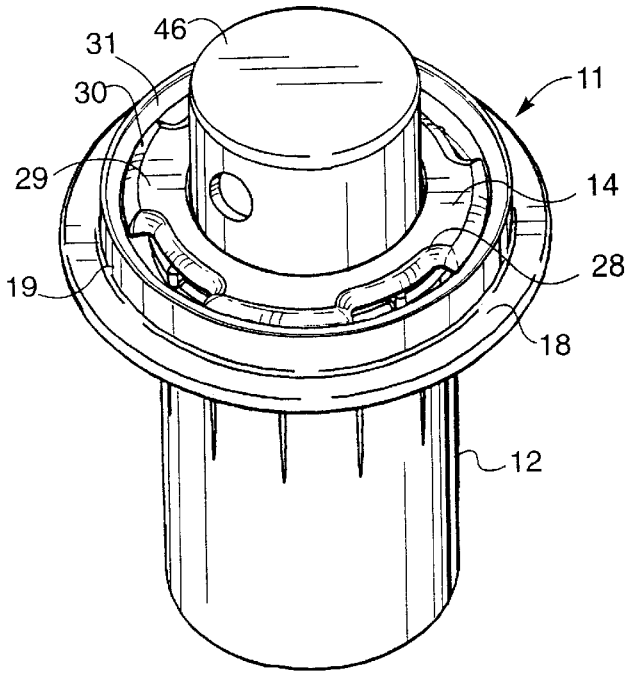
FIG. 1 is a perspective view of a pop-up water delivery system embodying the invention.

In the drawings the reference numeral 11 designates generally the pop-up water delivery system of the invention. The system comprises three major components, namely, a cylindrical body 12, a nozzle stem 13 and a retainer 14.

System body 12 has a cylindrical outer surface sized to fit tightly inside a pipe 16 for supplying pressurized water to system 11. In practice the piping system for the pool is assembled in place with extra length riser pipes 16 before the cement 17 is poured. Once the cement has set the riser pipes 16 are cut off flush with the surface of the cement. Adhesive is applied to the body 12 and/or the interior of pipe 16 and the body is pressed into the pipe until a flange 18 at its upper end seats against the surface of the concrete.

An upstanding cylindrical dam 19 on body flange 18 permits a layer of plaster 21 to be applied to the cement 17 without contaminating the interior of the body 12.

Figure 6:
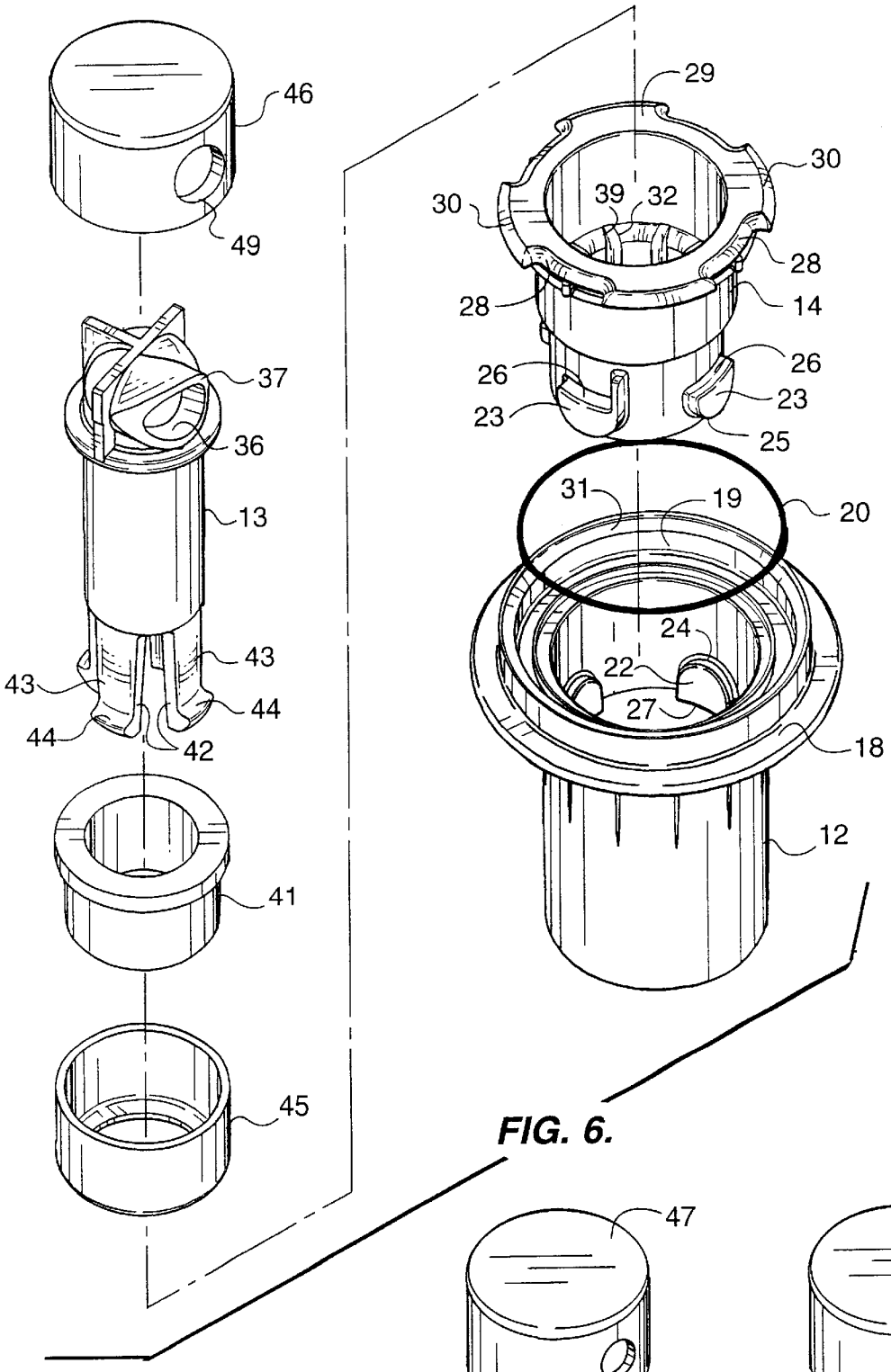
FIG. 6 is an exploded perspective view of the system.

Removably positioned within body 12 is the retainer 14 which is a generally cylindrical member adapted to guide and limit the up and down movement of nozzle stem 13. The retainer 14 is preferably removably attached to the body 12 by a bayonet type coupling composed of a plurality of lugs 22 on the interior surface of body 12 and a corresponding plurality of lugs 23 on the outer surface of retainer 14. (See FIG. 6.) The upper surfaces 24 on the body lugs 22 and the lower, or under, surfaces 25 on the retainer lugs are non-planar so when the retainer 14 is dropped or pressed into the body 12 the lugs 22 and 23 cam on each other rotating the retainer sufficiently to permit the retainer lugs 23 to drop beneath the body lugs 22.

When the retainer 14 is rotated clockwise as viewed from above, planar upper surfaces 26 of the retainer lugs 23 are moved under and into contact with planar surfaces 27 on the underside of body lugs 22. An upright stop 28 on one of the retainer lugs 23 stops rotation of the retainer 14 in locked position in the body 12.

Manipulation of the retainer 14 within the body 12 is by way of a forked tool (not shown) having spaced tines for engaging opposed recesses 28 in the rim of a circular flange 29 at the top of the retainer. The remainder of the periphery of the flange 29 is relieved, i.e. beveled, at 30 to provide, with recesses 28, a continuous recess for receiving the tines of the manipulating tool. Thus, if a service person seeking to remove a retainer places the tool on the retainer, but not exactly in the recesses 28, the groove provided by the relieved regions 30 of the retainer flange steadies the tool as it is turned to place the tines of the tool in recesses 28.

It is preferable to also provide a relief 31 on the upper inner edge of dam 19 on the body flange 18. This relief cooperates with the relieved rim 30 in providing the guide groove for the tool tines.

Positioned between the flange 18 of the body 12 and flange 29 on the retainer 14 is a resilient O-ring 20 which serves two purposes. First, it seals the outlet of the body 12 to prevent water from escaping around the retainer. Secondly, the O-ring provides frictional resistance to turning of the retainer 14 thereby preventing accidental disengagement of the bayonet lugs 22 and 23.

It is to be noted that the manipulating portion of the retainer 14, namely the recessed flange 29, lies entirely within the thickness of the plaster 21 portion of the pool wall. In other words, manipulating flange 29 does not intrude into the cement portion 17 of the pool wall. This allows the supply pipe 16 to surround and reinforce the body 12 to the surface of the cement. This also simplifies installation of the system because, as mentioned above, the pipe 16 can be cut off flush with the surface of the cement. Some prior installations required the pipe to be cut off beneath that surface—a more difficult task.

The inner surface of the lower portion of the retainer 14 is provided with a plurality of spaced apart vertical ribs 32. The ribs 32 closely confine and guide the middle region of the nozzle stem 13. With the spaces between the ribs 32 any debris that enters the water delivery system from pipe 16 is unlikely to become wedged between the ribs 32 and the nozzle stem 13.

The valve system directing pressurized water to the pop-up water delivery system 11 sometimes leaks and allows water to enter the system when the nozzle stem is retracted. The spaces between the ribs 32 also allow this water to escape from the system without raising the nozzle stem.

Figure 2:
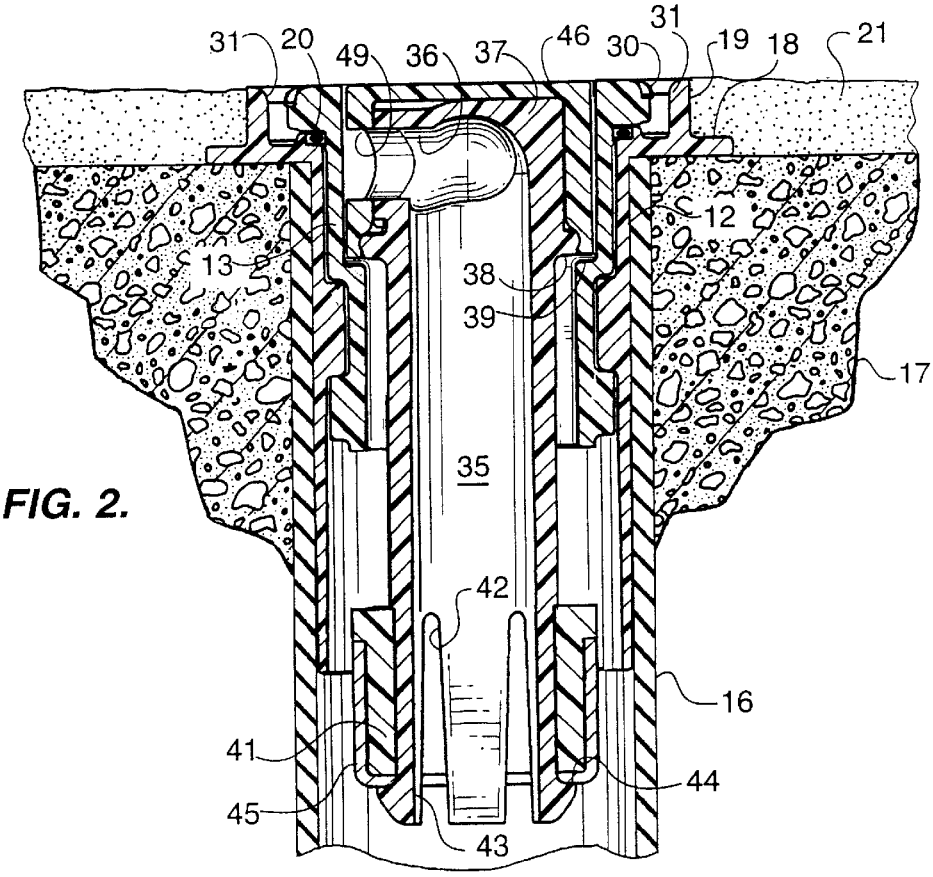
FIG. 2 is a vertical sectional view of the system of the invention shown installed in the floor of a swimming pool and with the nozzle stem in its inactive, retracted position.
Figure 3:
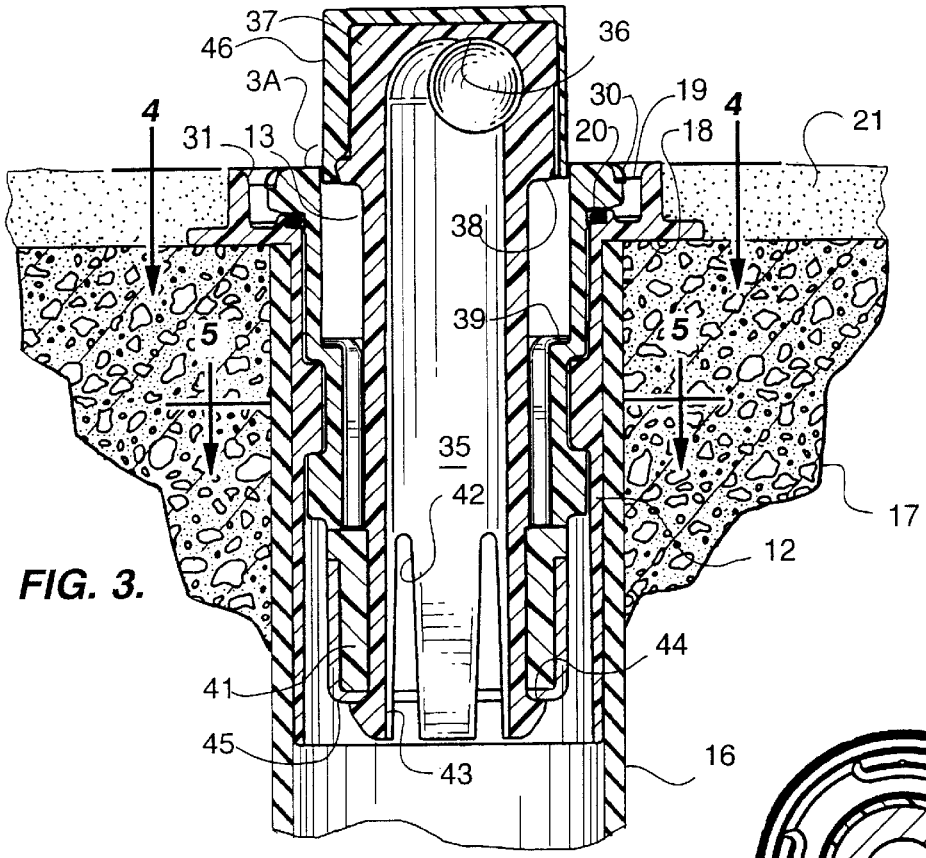
FIG. 3 is a vertical sectional view similar to FIG. 2, but taken at 90° from the FIG. 2 view, and showing the nozzle stem in its active, elevated position.

Nozzle stem 13 is an elongated tubular structure with an axial bore 35 communicating with a transverse nozzle 36 in an enlarged upper region 37 of the stem. The lower face 38 of the upper nozzle region 37 of stem 13 rests on a land 39 in the inner surface of retainer 14 when the stem is retracted and the nozzle is in an inactive position as shown in FIG. 2. When pressurized water is supplied to the system 11 the nozzle stem is driven upwardly to a position (FIG. 3) in which a metal weight 41 at the lower end of nozzle stem 13 contacts the lower edge of retainer 14.

It will be noted that the nozzle 36 from which water exits the nozzle stem 13 is off-center with respect to the center line, or vertical axis of the nozzle stem. Thus, reaction force from water leaving the nozzle imparts a turning movement to the nozzle stem as it rises. Each time the delivery system is activated a different area of the pool is swept.

The shock force of weight 41 being driven against the retainer 14 is transmitted via the lugs 23 and 22 to the body 12 which is reinforced by being adhered to pipe 16. Thus, although the retainer 14, the body 12 and the pipe 16 are all preferably made of plastic material, they possess sufficient mass and strength to resist the repeated shock forces.

The nozzle stem 13 is designed for quick and easy assembly with related components of the pop-up water delivery system. The lower end region of the stem 13 is slotted at 42 to provide longitudinal tines 43 in the bottom regions of the stem. Each tine 43 has an outwardly extending land 44 at its distal end. Nozzle stem 13 is preferably molded from plastic material which affords a degree of flexibility to the tines 43 which permits the stem 13 to be manually pushed through the retainer 14 and to allow the cylindrical metal weight and a decorative plastic cover 45 to be snapped into place on the stem. No fastener and no adhesives are required for assembly of these components. The arrangement also permits disassembly of the cover 45 and weight 41 from the stem 13 if that is desired to effect repairs.

The metal from which weight 41 is formed can become discolored from contact with pool water and the cover 45 serves to hide the discoloration.

Figure 6A:
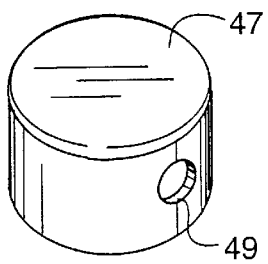
FIGS. 6A and 6B show optional nozzle caps that can be employed in the invention.
Figure 6B:
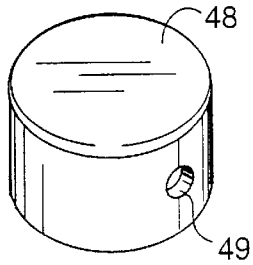

Different applications of the pop-up water delivery system may dictate that different quantities of water be delivered to sweep the surrounding surface area of the pool. In accordance with this invention that requirement is accommodated by offering a selection of nozzle covers 46, 47 and 48. (See FIGS. 6, 6A and 6B.) The covers have different sized outlet opening 49 therein.

Figure 3A:
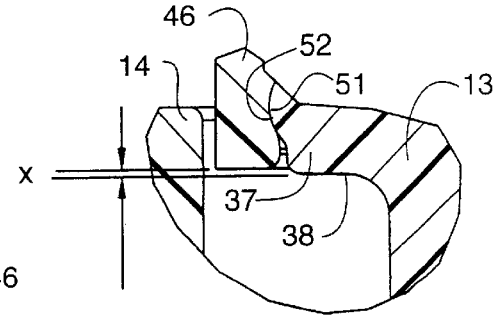
FIG. 3A is an enlarged fragmentary view of that area of FIG. 3 designated by circle 3A.
Figure 4A:
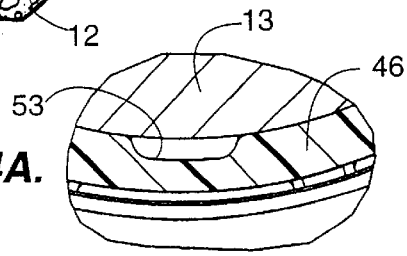
FIG. 4A is an enlarged fragmentary view of that area of FIG. 4 designated by the circle 4A.

Each nozzle cover 46, 47 and 48 has an indentation 51 around its lower periphery permitting the cover to be snapped in place over a ring projection 52 at the base of enlarged region 37 of the nozzle stem. (See FIG. 3A.)

To ensure that the nozzle cover 46 is not dislodged when the nozzle stem retracts and the lower face 38 of the upper region 37 of the stem strikes retainer land 39 the bottom rim of the cover terminates a short distance "x", above the surface 38 of the stem. (Again, see FIG. 3A.)

Figure 4:
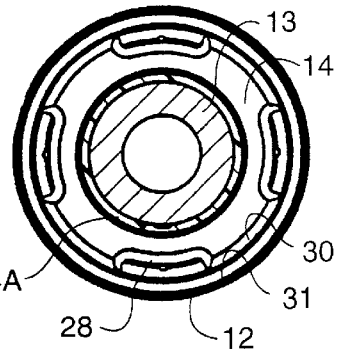
FIG. 4 is a horizontal sectional view of the system taken generally as indicated by line 4—4 in FIG. 3.
Figure 5:
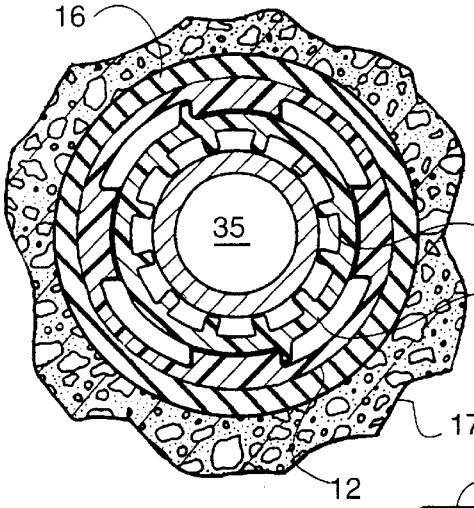
FIG. 5 is a horizontal sectional view of the system taken generally as indicated by line 5—5 FIG. 3.

To ensure that the outlet opening 49 in each nozzle cover 46, 47 and 48 is properly aligned with stem nozzle 36 each cover and the region 37 of the nozzle stem 14 are provided with an alignment key and keyway arrangement. In the arrangement shown in FIG. 4 and enlargement 4A the keyway 53 is provided in the cover.

Keyway 53 can serve another purpose as well. The keyway 52 allows water to escape from beneath the cap 46 so that it does not pop the cap off the stem when the system is pressurized.

From the foregoing it should be apparent that this invention provides an improved pop-up water delivery system with a variety of improvements contributing to its performance and reliability.

What is claimed is:

1. An intermittently activated water delivery system for cleaning a swimming pool, comprising:

a) a generally cylindrical body in communication with a source of water under pressure, said body having an upper surface and being in open communication with the interior of the pool at a surface of the pool structure;

b) a stem having an axial bore and a nozzle portion at an upper region thereof, said stem being axially positioned in said body and axially moveable from an inactive, retracted position therein to an active position in which the nozzle portion thereof projects outside the body within the pool when water under pressure is supplied to the body; and c) a generally cylindrical retainer in said body between the body and the stem for guiding movement of the stem;

the improvement comprising:

d) the said retainer has an upper surface which is substantially flush with the upper surface of the said body;

e) the upper surface of said retainer having opposed peripheral recesses therein for receiving a pronged tool for dismantling the retainer from the body; and f) the peripheral edge of the upper surface of the retainer is relieved to receive and guide the pronged tool.

2. The water delivery system of claim 1 wherein g) the inner edge of upper surface of the body is relieved to further receive and guide the pronged tool.

3. An intermittently activated water delivery system in a pool wall having a cement portion and a plaster portion overlying the cement, said system comprising:

a) a generally cylindrical body in communication with a source of water under pressure, said body being in open communication with the interior of the pool at a surface of the plaster portion of the pool wall;

b) a stem having an axial bore and a nozzle portion at an upper region thereof, said stem being axially positioned in said body and axially moveable from an inactive, retracted position therein to an active position in which the nozzle portion thereof projects outside the body within the pool when water under pressure is supplied to the body;

c) a generally cylindrical retainer in said body between the body and the stem for guiding movement of the stem;

d) the said retainer has an upper surface which is substantially flush with the surface of the plaster portion of the pool wall;

e) the upper surface of said retainer being provided by a flange having opposed peripheral recesses therein for receiving a pronged tool for dismantling the retainer from the body;

f) said flange being positioned entirely within the plaster portion of the pool wall and outside the cement portion of the pool wall; and g) a supply pipe surrounding said body and extending through the cement to the plaster of the pool wall.

4. The delivery system of claim 3 further comprising a resilient O-ring between the flange on the retainer and the body.

* * * * *